US005367795A

United States Patent [19]

Iverson et al.

[11] Patent Number: 5,367,795

[45] Date of Patent: Nov. 29, 1994

[54] SHOE HAVING INDIVIDUALIZED DISPLAY AREAS

[75] Inventors: Donald D. Iverson, McLean; Thomas A. Strobel, Sterling, both of Va.

[73] Assignee: Gamer Corporation, McLean, Va.

[21] Appl. No.: 126,659

[22] Filed: Sep. 27, 1993

Related U.S. Application Data

[63] Continuation-in-part of Ser. No. 102,831, Aug. 6, 1993, which is a continuation-in-part of Ser. No. 936,204, Aug. 27, 1992, abandoned.

[51] Int. Cl.[5] ..... A43B 23/00

[52] U.S. Cl. ..... 36/136; 36/45

[58] Field of Search ..... 36/1, 45, 132, 136; 2/245, 246; 40/636

[56] References Cited

U.S. PATENT DOCUMENTS

| | | | |
|---|---|---|---|
| 512,468 | 1/1894 | Grundy | 36/136 |
| 1,520,224 | 12/1924 | Bush | 36/1 X |
| 1,531,806 | 3/1925 | Nutt | 36/1 |
| 1,952,409 | 3/1934 | Berg | 36/1 X |
| 2,583,826 | 1/1952 | Fischer | 36/1 X |
| 2,647,261 | 8/1953 | Rassner | 2/115 |
| 2,801,477 | 8/1957 | Adams et al. | 36/136 X |
| 2,986,743 | 6/1961 | Eilen | 2/247 |
| 3,738,299 | 6/1973 | Packler et al. | 2/246 X |
| 3,816,211 | 6/1974 | Haigh | 2/246 X |
| 3,829,995 | 8/1974 | Fakoury | 40/16 |
| 4,089,722 | 5/1978 | Holoubek | 2/246 X |
| 4,389,801 | 6/1983 | Sharrock et al. | 40/16 X |
| 4,517,910 | 5/1985 | Jalowsky | 2/244 |
| 4,610,102 | 9/1986 | Hill | 36/136 |
| 4,611,416 | 9/1986 | Lin | 36/136 |
| 4,621,441 | 11/1986 | Wagner et al. | 36/136 X |
| 4,644,673 | 2/1987 | Gamm | 36/136 |
| 4,697,362 | 10/1987 | Wasserman | 36/136 |
| 4,776,043 | 10/1988 | Coleman | 2/199 |
| 4,852,276 | 8/1989 | Savoca et al. | 36/136 |
| 5,121,505 | 6/1992 | Ludmer et al. | 2/94 |

*Primary Examiner*—Jimmy G. Foster
*Assistant Examiner*—Beth Anne C. Cicconi
*Attorney, Agent, or Firm*—Sixbey, Friedman, Leedom & Ferguson

[57] ABSTRACT

A shoe and method of forming the same having an upper portion which includes an individualized indicia display area in any one or more of the side quarter panel, tongue, or heel portion of the upper portion of the shoe. The shoe includes an outer covering material in which a window or opening is formed to make visible and accessible an indicia attachment panel underlying the outer covering material. A frame member having substantially the same shape as the window or opening projects from the indicia attachment panel through the window or opening with the outer perimetric edges of the frame member legs closely adjacent the corresponding perimetric edges of the window or opening. An indicia display panel is adhered, preferably by stitching, to the indicia attachment panel with the perimetric edges of the indicia display panel in abutting contact with the inner perimetric edges of the frame member legs. The display panel is formed from a plurality of individual indicia or is a unitary panel to which indicia, such as letters, numbers, or emblems, are applied. The purchaser has the ability to individualize the shoe in virtually unlimited manner to include a personalized message or slogan that no other purchaser may have.

36 Claims, 2 Drawing Sheets

SHOE HAVING INDIVIDUALIZED DISPLAY AREAS

CROSS REFERENCE TO RELATED APPLICATIONS

This application is a continuation-in-part of pending application Ser. No. 08/102,831, filed Aug. 6, 1993 which, in turn, is a continuation-in-part of application Ser. No. 07/936,204, filed Aug. 27, 1992, now abandoned.

BACKGROUND OF THE INVENTION

1. Technical Field of the Invention

The present invention relates generally to footwear and, more particularly, to footwear which includes at least one individualized shoe panel display for personalizing the shoe to the individual. More specifically, this invention relates to a shoe and method for making the same which includes a shoe display panel comprising an indicia panel or a plurality of indicia units secured to a portion of the shoe to create a virtually unlimited supply of personalized messages for the wearer of the shoe.

2. Description of the Prior Art

Footwear has become not only a means for protecting feet from the elements, but also a fashion statement to express ones own personality. In addition, many people are becoming more and more health and exercise conscious, which has tremendously boosted the sale of athletic shoes. One can hardly sit down to watch television without being bombarded with a whole series of different athletic shoe commercials. Unfortunately, most of the shoes sold today merely include logos and shoe manufacturer's trademarks and, therefore, do not give the wearer the ability to personalize the shoes' appearance.

U.S. Pat. No. 4,697,362 to Wasserman discloses a removable indicia bearing tab for footwear, particularly athletic shoes, which allows the fashion of the shoe to change depending upon the tab chosen. Specifically, the tab includes identifying indicia or colors wherein the entire tab may be attachable to and removable from various components of the shoe, such as the tongue, quarter portion, or the side of the shoe sole. The tab is preferably affixed to a recessed area in the particular shoe portion by Velcro. The indicia are primarily fanciful designs, tradenames, trademarks, or service marks.

U.S. Pat. No. 4,610,102 to Hill discloses a Velcro-encapsulated label for shoes and the like which includes a Velcro patch having a cut-out window to accommodate an identification or health information tag. The cut-out window and tag are preferably located in the heel region of the shoe. The window, however, is designed to be covered by a flap of material carrying Velcro which is attachable to a corresponding Velcro patch on the shoe. This is to protect the tag from the elements. As a result, the tag is not normally visible during normal use and, therefore, fails to provide the user with a visible means of individualizing one's shoe.

U.S. Pat. No. 4,611,416 to Lin discloses an athletic shoe with a display portion which is visible during use. Specifically, the shoe includes a window formed in the quarter and outer covering portions of the shoe. A zippered access opening is provided between the quarter and outer material portions to allow the insertion of an information card therewithin which will be visible in the window. The information card may include a wide range of information, such as trademarks, ornamental designs, messages and the like. Due to the construction steps necessary to provide the access opening, zipper closure therefor and transparent window, the cost of the shoe is substantial and does not provide a commercially inexpensive means of individualizing a shoe.

U.S. Pat. No. 2,801,477 to Adams et al. is directed to an ornamental attachment for shoes which comprises a means for changing the character of a shoe without modifying the structure of the shoe by providing a transparent, patch-like pocket in the upper portion of the shoe. A plaque shaped to fill the pocket is insertable therein. Such a pocket increases the cost of the shoe and substantially alters the ultimate shoe design and the requirement for a specially shaped plaque makes it difficult for individuals to personalize the shoes.

U.S. Pat. No. 4,852,276 to Savoca et al. is directed to a shoe having a replaceable logo insert adhesively secured by an acrylic pressure sensitive adhesive within an opening formed in the side of the shoe. The opening includes a flexible lip around its periphery for the purpose of overlapping the peripheral edges of the insert in order to hold it securely in place. However, positioning the insert edge under the flexible lip tends to abrade the periphery of fabric inserts and, therefore, requires that more expensive, non-abradable, relatively rigid insert materials be employed.

Consequently, a commercially inexpensive means of individualizing a shoe is needed which provides the user with a virtually unlimited number of possible individualized messages or slogans without significantly altering the style of the shoe or increasing the costs of manufacture. Specifically, a shoe which allows the wearer to include indicia which are particularly designed by the wearer would provide a particularly desirable and commercially less expensive personalized shoe.

SUMMARY OF THE INVENTION

Therefore, the primary object of the present invention is to overcome the deficiencies of the prior art, as described above, and specifically, to provide a shoe which allows the purchaser and ultimate wearer to individualize the shoe in a virtually unlimited fashion and in a commercially inexpensive manner.

Another object of the present invention is to provide a shoe having at least one indicia display area which includes a wearer-designed indicia panel or plurality of individual indicia units, such as individual letters, numbers, emblems, or colors, to provide a commercially inexpensive, individualized display.

Still another object of the present invention is to provide a shoe having an outer covering material permanently affixed to the upper portion of the shoe, a window or display opening area formed in a portion of the outer covering material and an indicia attachment panel underlying a portion of the outer covering material and both visible and accessible through the window or opening for securing thereon an indicia display in the form of an indicia panel or a plurality of individual indicia units, such as letters, numbers, emblems, or colors, to provide a virtually unlimited number of possible individualized messages in a commercially inexpensive manner.

Yet another object of the present invention is to provide a method for forming a shoe which includes the steps of providing, on the upper portion of the shoe, an indicia attachment panel having an outwardly projecting frame member, securing an outer covering material to the upper portion of the shoe in overlying relationship to the indicia attachment panel, providing a window or display opening in a portion of the outer covering material which overlies the indicia attachment panel so that the panel is visible in and accessible through the window or opening and the frame member projects through the window or opening with the outer perimetric edges of the frame member legs closely adjacent the corresponding perimetric edges of the window or opening, and securing an indicia display panel to the indicia attachment panel in the window or opening with the outer dimensional extent or perimetric edges of the indicia display panel in abutting contact with the inner perimetric edges of the frame member.

The foregoing objects are achieved by providing a shoe and method of forming the same having a shoe body upper portion which includes an indicia display area in any one or more of the side quarter panel, tongue, or heel portion of the shoe. The shoe includes an outer covering material defining a window or opening therein through which an indicia attachment panel is visible and accessible and a fixed dimension frame member, preferably having substantially the same size and shape as the window or opening, projects outwardly from the indicia attachment panel for providing the border for the display area. The indicia attachment panel is preferably formed of a material which permits indicia, which may include an indicia display panel or a plurality of individual indicia units, such as individual letters, numbers, or emblems, to be secured thereon within the frame member after the entire shoe has been formed. Because indicia display panels are simple and inexpensive to form and since individual letters and numbers may be utilized, alone or in combination, to form the indicia display, the purchaser has the ability to personalize the shoe in a virtually unlimited manner to include a unique message or slogan that no other purchaser may have. Furthermore, the purchaser is in no way limited to certain logos or emblems which the shoe manufacture chooses to market, nor do individual messages require a special order.

Figure 1:
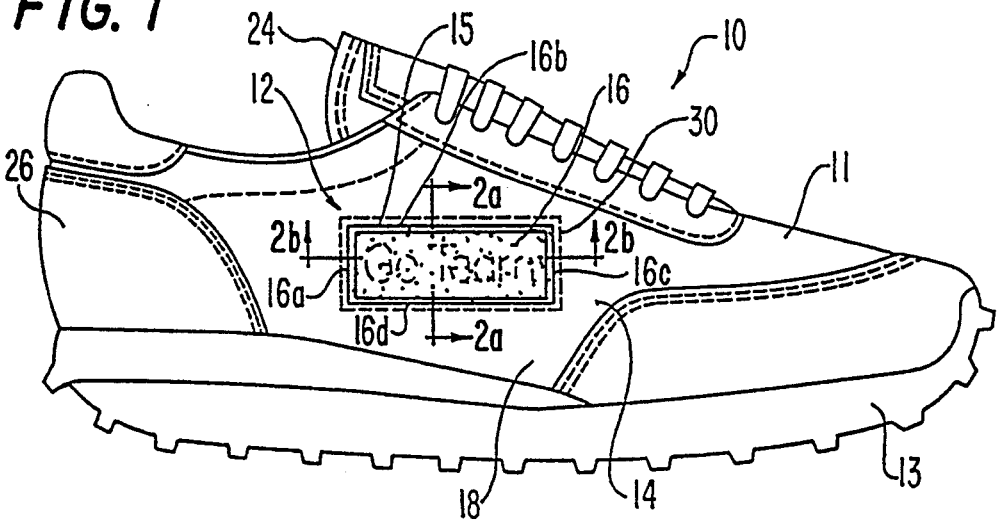
FIG. 1 is a side view of a first embodiment of a shoe made in accordance with the present invention to include an individualized indicia display area.
Figure 2A:
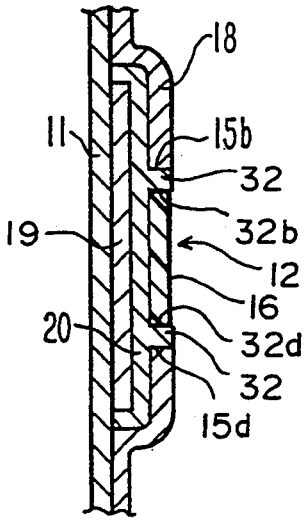
Figure 2B:
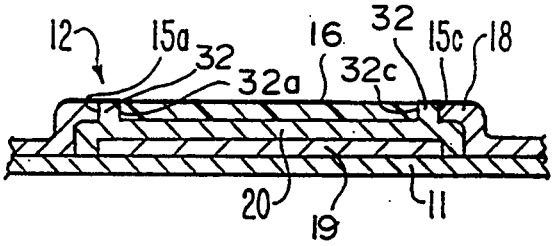

FIG. *2a* is a cross-sectional view of the indicia display area taken along line *2a—2a* of FIG. 1.

FIG. *2b* is a cross sectional view of the indicia display area taken along line *2b—2b* of FIG. 1.

Figure 3:
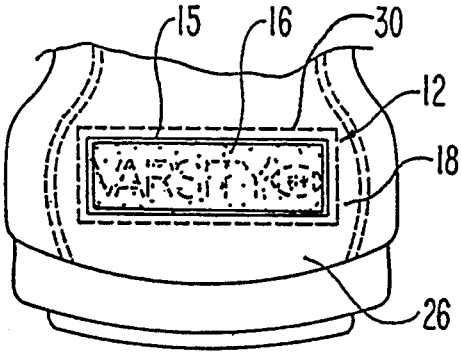

FIG. 3 is a partial rear view of a shoe made in accordance with the present invention.

Figure 4:
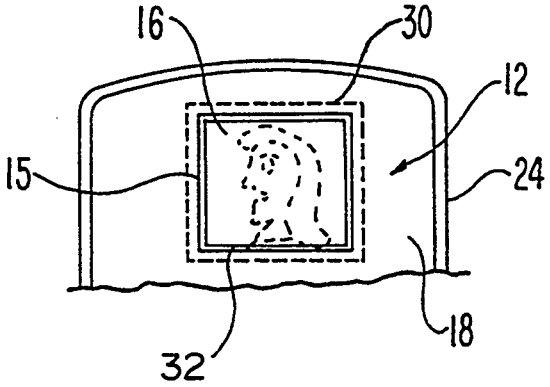

FIG. 4 is a partial top view of the tongue of a shoe made in accordance with the present invention.

Figure 5:
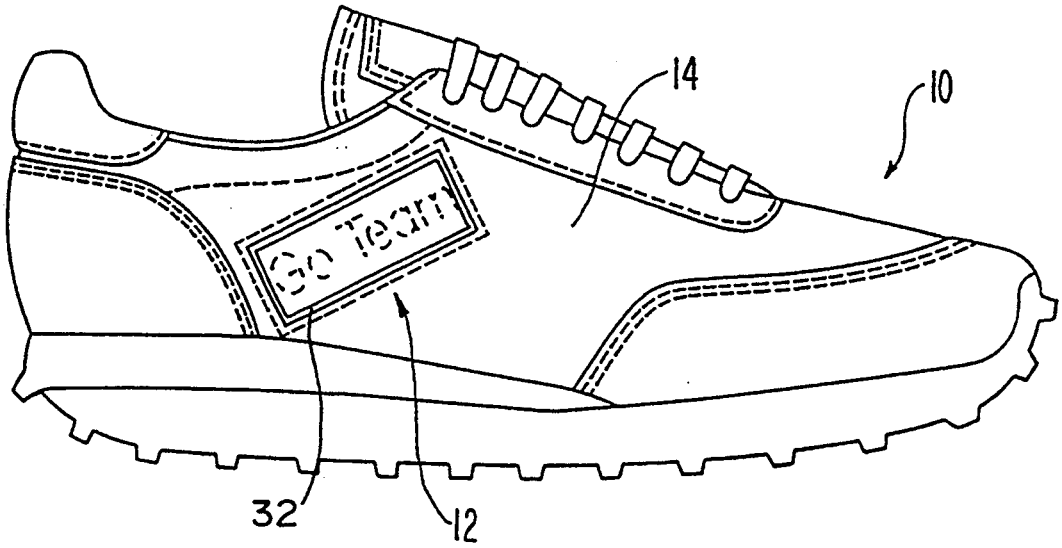

FIG. 5 is a side view of a second embodiment of a shoe made in accordance with the present invention.

DETAILED DESCRIPTION OF THE INVENTION

For a clear understanding of the present invention, attention is initially directed to a shoe 10 having a main body or upper portion 11, preferably formed of leather, a sole 13, and an outer covering material 18 trimming upper portion 11. The outer covering material 18 is preferably formed of a vinyl material, such as polyvinyl chloride, and overlies selected areas of upper portion 11. Specifically, FIG. 1 illustrates one embodiment of an athletic shoe made in accordance with the present invention including an indicia display area 12 in shoe quarter portion 14, comprising a window or display opening 15 through which an indicia display panel 16 is visible. Display panel 16 may be a unitary panel to which indicia may be applied or a number of separate individual indicia arranged side-by-side to make up a message specially designed by the purchaser of the shoe. The indicia, whether individual or applied to a unitary panel, may comprise letters, numbers, emblems, etc. As a result, there is virtually no limit to the number of unique messages or designs possible. Indicia display panel 16 or the individual indicia comprising the panel may be made from felt, flock, light film, vinyl or other suitable material with the actual indicia printed, embroidered or otherwise applied thereto. Moreover, the present invention is not limited only to the athletic style of shoe illustrated in the figures but encompasses any shoe type.

With reference to FIGS. *2a* and *2b*, it can be seen that sandwiched between main body upper portion 11 and outer covering material 18 is a reinforcing panel 19 and, overlying the reinforcing panel 19, is an indicia attachment panel 20. Both the reinforcing panel 19 and the indicia attachment panel 20 are preferably adhesively and via stitching attached to upper portion 11 and outer covering material 18. Reinforcing panel 19 is preferably polymeric (e.g., nylon, polyester), cotton, or a combination of polymer and cotton and may be either woven or non-woven. The indicia display area 12 includes a window or display opening 15 formed in outer covering material 18 and through which indicia attachment panel 20 is both visible and accessible. Indicia attachment panel 20 is made from a material which is durable enough to withstand the elements while also providing a sufficient area for attachment of the indicia display panel 16 thereto. For these purposes, indicia attachment panel 20 is preferably made from a porous material which may be polymeric (preferably polyester), cotton or a combination of polymer and cotton fabric material. Indicia display areas 12 may also be located upon the tongue 24 and heel portion 26 of shoe 10, as shown in the Figures discussed below. In each case the areas 12 comprise a window or opening 15 formed in the outer covering material 18 and through which an indicia attachment panel 20 is both visible and accessible. The indicia display panel 16 is attached to the indicia attachment panel 20 within the window or opening 15 in a manner to be described hereinafter.

The relative positioning of each of the layers and panels of the present invention is readily apparent from FIGS. *2a* and *2b*. Reinforcing panel 19 overlies main body upper portion 11, indicia attachment panel 20 overlies reinforcing panel 19 and outer covering material 18 overlies reinforcing panel 19, indicia attachment panel 20 and main body upper portion 11. Window or opening 15 is formed in a portion of outer covering material 18 which overlies indicia attachment panel 20 and indicia display panel 16 is positioned within the window or opening 15 and affixed either adhesively or via stitching to indicia attachment panel 20. Interposed between the peripheral edges or outer dimensional extent 16*a*, 16*b*, 16*c* and 16*d* of the indicia display panel 16 and the perimetric edges 15*a*, 15*b*, 15*c* and 15*d* of window or opening 15 and projecting outwardly from indicia attachment panel 20 is a fixed dimension frame member 32 comprising a plurality of legs defining a closed perimeter shape which is preferably substantially the same as the shape of window or opening 15 and which fits closely within the window or opening 15 with the outer perimetric edges of the frame member legs closely adjacent and, desirably, in abutting contact with the corresponding perimetric edges 15*a*, 15*b*, 15*c* and 15*d* of window or opening 15. The peripheral edges or outer dimensional extent 16*a*, 16*b*, 16*c* and 16*d* of indicia display panel 16 are positioned in abutting, edge-to-edge relationship, with the corresponding inner perimetric edges 32*a*, 32*b*, 32*c* and 32*d* of the frame member legs. Desirably, frame member 32 is a thermoplastic rubber frame which is molded integrally with indicia attachment panel 20. To accomodate the molding process and facilitate a good bond with frame member 32, indicia attachment panel 20 is preferably a porous polymeric fabric. Frame member 32 projects outwardly from indicia attachment panel 20 a distance about equal to the thickness of outer covering material 18 in order that the outermost edges of frame member 32 are substantially coplanar with outer covering material 18. Because outer covering material 18 is made from a relatively thick material, desirably thicker at its perimetric edges than indicia display panel 16 at its peripheral edges, frame member 32 provides a protective border to indicia display panel 16 by contacting the outer dimensional extent thereof. As a result, the indicia display panel 16 is protected from abrasion. If desired, the peripheral edges of indicia display panel 16 may be reinforced, as by stitching, embroidering, coating or other known techniques, to provide a less flexible, thickened edge for abutting with the inner perimetric edges of the frame member legs. Reinforcement of the peripheral edges of indicia display panel 16, for example, by stitching or embroidering, is particularly desirable when indicia display panel 16 is affixed to indicia attachment panel 20 by stitching rather than with adhesive. In addition, the perimetric edges of the window or opening 15 can be stiffened to provide a more rigid border for supporting frame member 32 by providing stitching 30 closely adjacent and around the perimeter of window or opening 15.

FIG. 3 shows indicia display area 12 located in heel portion 26 of shoe 10. Again, indicia attachment panel 20 and outer covering material 18 are provided over a portion of the main shoe body, for example by stitching thereto, as shown, or by adhesively attaching thereto. FIG. 3 also illustrates the variety of messages which are possible. Particularly, it is noted that indicia display panel 16 includes both letters and an emblem to provide a personal message.

FIG. 4 shows indicia display area 12 located on tongue 24 of shoe 10. Inasmuch as tongue 24 is formed of flexible foam, it will be appreciated, as described above, that both reinforcing panel 19 and indicia attachment panel 20 are positioned overlying the foam tongue and outer covering material 18 is provided overlying at least the portion of the tongue which includes the indicia attachment panel 20 and frame member 32. Indicia display panel 16 illustrates yet another example of the variety of messages which may be included.

FIG. 5 merely illustrates a second embodiment of the present invention wherein indicia display area 12 is positioned at an angle in quarter portion 14 of shoe 10. In this regard, display area 12 may be located in numerous positions and at a variety of angles on shoe 10.

The method of forming indicia display area 12 is commercially inexpensive. Specifically, reinforcing panel 19, indicia attachment panel 20 with frame member 32 projecting outwardly therefrom and outer covering material 18 are attached over a portion of the main body upper shoe portion 11 which is to include the display area. Reinforcing panel 19, indicia attachment panel 20 and outer covering material 18 may each be stitched to the main shoe body and to each other and/or secured using conventional adhesives. Preferably, outer covering material 18 is a decorative strip for shoe 10. A window or display opening 15 is formed in outer covering material 18 in an area thereof which overlies indicia attachment panel 20 and frame member 32 and is sized to the dimensions of frame member 32 which, in turn, has been sized to the dimensions of indicia display panel 16. The dimensions may be varied to any desired size and shape, being limited only by the size of the shoe portion in which the display panel is to be included. The indicia attachment panel 20, sandwiched between outer covering material 18 and reinforcing panel 19, is visible and accessible, and frame member 32 projects, through window or opening 15. A personalized message may then be formed on indicia display panel 16, either by a variety of individual indicia or as a unitary panel, and adhered to the portion of indicia attachment panel 20 within the perimeter of frame member 32.

It is important to the present invention and, particularly, for a continuing neat appearance of the shoe, that the peripheral edges of indicia display panel 16 are protected from abrasion by abutting, edge-to-edge contact with a protective border. In many instances the perimetric edges of window or opening 15 provide an effective border for that purpose. However, it frequently occurs in forming the shoe that the shoe upper portion 11 and outer covering material 18 stretch and bend relative to one another with the result that the window or opening 15 deforms somewhat from its intended shape. When this occurs, a pre-formed indicia display panel 16 will not fit within window or opening 15 with its peripheral edges in abutting, edge-to-edge relationship with the perimetric edges thereof around the entire periphery of the indicia display panel 16. This necessitates custom forming or hand trimming each indicia display panel 16 to the deformed shape of the window or opening 15 which, it will be appreciated, is impractical for large volume production purposes. The interposition of fixed dimension frame member 32 between the perimetric edges of the window or opening 15 and the indicia display panel 16 assures that the indicia display panel can be pre-formed to predetermined dimensions and will always fit within frame member 32 in abutting, edge-to-edge contact with the inner perimetric edges 32*a*, 32*b*, 32*c* and 32*d* thereof.

The ability to provide virtually unlimited possible messages in indicia display area 12 while, at the same time, permitting large volume production of the shoes, is due, in large part, to the manner by which the indicia are attached to indicia attachment panel 20. The preferred method of attachment for high volume production purposes is by stitching the indicia display panel 16 to the indicia attachment panel 20 along, but inwardly of, the peripheral edges of indicia display panel 16. When attachment is accomplished by stitching in this manner it is preferred that the peripheral edges of the indicia display panel 16 be reinforced, as by stitching or embroidering. When attachment is accomplished other than by stitching, a desirable method is by contact adhesive, preferably with a fabric-to-fabric adhesive to adhere fabric indicia to the porous attachment panel. A suitable adhesive is commercially available under the name Aleene's OK TO WASH IT fabric glue.

Another method of attaching the indicia to attachment panel 20 is by utilizing a heat sealing adhesive. As set forth above, indicia attachment panel 20 is preferably made from a porous material. Such a material allows the heat sealing adhesive to penetrate the fibers of the panel and provide an effective seal. Conventional heat sealing adhesives are contemplated for use in the present invention. The importance of making indicia attachment panel 20 from porous material becomes readily apparent from the fact that a majority of athletic shoes made today are made from vinyl, leather, or the like which provide no room for melting of the heat sealing adhesive therein. Furthermore, most of these materials are provided with some type of waterproofing chemical which would also inhibit the ability to heat seal indicia thereto. A porous indicia attachment panel 20, on the other hand, permits the heat sealing adhesive to penetrate the fibers of the panel.

A heat sealing machine, a specially designed iron, or a conventional flat iron may be used to attach the indicia display panel 16 to the indicia attachment panel 20. For example, the surface of attachment panel 20 can be heated for 20 seconds at a temperature of 375° C. Once the surface is heated, an indicia display panel 16 can be applied directly to the surface. A cloth is placed over the indicia to protect the outer surface from heat and the heat sealing machine or iron is placed on top of the cloth for 20 to 25 seconds depending upon the type of heat sealing adhesive used. This method is merely provided as an example. The present invention contemplates any known method of heat sealing capable of attaching an indicia display panel 16 to attachment panel 20.

In addition to heat sealing, a pressure sensitive adhesive may also be utilized. Pressure sensitive adhesives eliminate the need for heat to connect the indicia display panel 16 to the attachment panel 20. This allows the user to readily attach his or her own letters or panel to the shoe even after the shoe has been purchased.

The present invention provides durability to the messages provided in display area 12 and a means to decorate a wide variety of shoes by providing a fixed dimension frame member 32 which projects sufficiently from indicia attachment panel 20 through window or opening 15 to protect the indicia display panel 16 which is attached within display window or opening 15 by providing an abutting border therefor. The present invention contemplates producing shoes which include the individualized message from customer orders, as well as producing shoes including only blank display areas so that the messages may be printed on pre-dimensioned indicia display panels 16 and attached where the shoes are purchased. In addition, individual indicia or predimensioned unitary panels may be sold separately by shoe or sporting goods outlets, and the purchasers may attach the individual indicia themselves. Furthermore, heat transfer shops or department stores carrying shoes designed in accordance with the present invention may provide attachment services.

It is understood that various additional changes and modifications in the form and detail of the present invention illustrated in detail above may be made without departing from the scope and spirit of the present invention, as well as the invention's use in a variety of applications and shoe designs. It is, therefore, the intention of the inventors to be limited only by the following claims.

We claim:

1. A shoe having an upper portion including a quarter portion, heel and tongue comprising:

(a) outer covering material permanently affixed to said upper portion of the shoe;

(b) an indicia display opening formed in a portion of the outer covering material and located in at least one of said quarter portion, heel and tongue of said upper portion;

(c) an indicia attachment panel underlying said outer covering material and both visible and accessible through said opening;

(d) a frame member having a plurality of legs defining a closed perimeter shape projecting from said indicia attachment panel through said opening, said legs having outer perimetric edges facing the perimetric edges of said opening and inner perimetric edges; and (e) an indicia display panel which is visible through said opening, said indicia display panel being positioned on and secured to said indicia attachment panel within said display opening so that the peripheral edges of said display panel are in abutting contact with the inner perimetric edges of said frame member legs for protecting said display panel edges from abrasion.

2. The shoe of claim 1, wherein said frame member legs at their inner perimetric edges have a thickness at least equal to the thickness of said display panel at its peripheral edges.

3. The shoe of claim 2, wherein said frame member legs have a thickness substantially equal to the thickness of said outer covering material at the perimetric edges of said display opening.

4. The shoe of claim 1, wherein the shape defined by said frame member legs is substantially the same as the shape of said display opening.

5. The shoe of claim 4, wherein the shape defined by said frame member legs is substantially the same size as said display opening.

6. The shoe of claim 5, wherein the outer perimetric edges of said frame member legs are closely adjacent the perimetric edges of said display opening.

7. The shoe of claim 6, wherein the outer perimetric edges of said frame member legs are in abutting contact with the perimetric edges of said display opening around substantially the entire perimeter of said display opening.

8. The shoe of claim 1, wherein said frame member is attached to said indicia attachment panel.

9. The shoe of claim 8, wherein said frame member is integral with said indicia attachment panel.

10. The shoe of claim 9, wherein said indicia attachment panel is formed of a polymer-containing fabric bonded to a polymer-containing frame member.

11. The shoe of claim 1, further including a reinforcing panel interposed between said outer covering material and said indicia attachment panel.

12. The shoe of claim 11, wherein said reinforcing panel is a woven or non-woven sheet formed of a material selected from the group consisting of polymers, cotton and mixtures thereof.

13. The shoe of claim 1, wherein said indicia display panel is secured by stitching to said indicia attachment panel.

14. The shoe of claim 13, wherein said stitching is positioned inwardly of the peripheral edges of said indicia display panel.

15. The shoe of claim 14, wherein the peripheral edges of said indicia display panel are reinforced.

16. The shoe of claim 1, wherein said indicia display panel is adhesively secured to said indicia attachment panel.

17. The shoe of claim 16, wherein said indicia attachment panel comprises a porous panel and said indicia display panel is adhered to said porous panel within said frame member by an adhesive which becomes integral with said porous panel to provide a seal therebetween.

18. The shoe of claim 16, wherein said indicia attachment panel comprises a porous panel and said indicia display panel is adhered to said porous panel within said frame member by a fabric-to-fabric contact adhesive.

19. The shoe of claim 16, wherein said indicia attachment panel comprises a porous panel and said indicia display panel is adhered to said porous panel within said frame member by a heat sealing adhesive such that said heat sealing adhesive melts into said porous panel.

20. The shoe of claim 16, wherein said indicia attachment panel comprises a porous panel and said indicia display panel is adhered to said porous panel within said frame member by pressure sensitive adhesive such that said pressure sensitive adhesive is compressed integrally into said porous panel.

21. The shoe of claim 16, wherein said indicia attachment panel comprises a porous panel and said indicia display panel is adhered to said porous panel within said frame member by heat transfer.

22. The shoe of claim 1, wherein said outer covering material is polyvinyl chloride.

23. The shoe of claim 1, wherein said indicia display panel comprises a plurality of individual indicia units.

24. The shoe of claim 23, wherein said plurality of indicia units consist of at least one of individual letters, emblems, numbers and colors.

25. The shoe of claim 1, wherein the peripheral edges of said indicia display panel are reinforced.

26. The shoe of claim 1, including stitching positioned closely adjacent to and around the perimeter of said display opening for securing said outer covering material to said upper portion of the shoe and for rigidifying the perimetric edges of said display opening.

27. A shoe having an upper portion including a quarter portion, heel and tongue comprising:

(a) outer covering material permanently affixed to said upper portion of the shoe;

(b) an indicia display opening formed in a portion of the outer covering material and located in at least one of said quarter portion, heel and tongue of said upper portion;

(c) an indicia attachment panel underlying said outer covering material and both visible in and accessible through said opening;

(d) a frame member having a plurality of legs defining a closed perimeter shape projecting from said indicia attachment panel through said opening, said legs having outer perimetric edges facing the perimetric edges of said opening and inner perimetric edges; and (e) an indicia display panel which is visible through said opening, said indicia display panel being positioned on and secured to said indicia attachment panel and having an outer dimensional extent, said frame member being sized and shaped so that its inner perimetric edges are in abutting contact with the outer dimensional extent of said indicia display panel, said frame member legs at their inner perimetric edges having a thickness which is at least equal to the thickness of said indicia display panel at its outer dimensional extent to thereby provide a protective border for said display panel edges.

28. A method of fabricating an individualized display in a shoe having an upper portion including a quarter portion, heel and tongue comprising:

(a) securing an outer covering material to said upper portion of the shoe to permanently affix said outer covering material to said upper portion of the shoe;

(b) securing an indicia attachment panel underlying said outer covering material;

(c) providing a display opening area in a portion of the outer covering material in at least one of said quarter portion, heel and tongue of said upper portion for making said indicia attachment panel visible in and accessible through said opening;

(d) providing a frame member having a plurality of legs defining a closed perimeter shape projecting from said indicia attachment panel through said opening; and (e) securing an indicia display panel to said indicia attachment panel within said frame member, such that the peripheral edges of said display panel are in abutting contact with the inner perimetric edges of said frame member legs.

29. The method of claim 28, wherein said frame member is sized and shaped to substantially the same size and shape as said opening and said frame member is positioned within said opening such that said frame member legs are in abutting contact with the perimetric edges of said display opening around substantially the entire perimeter of said display opening.

30. The method of claim 28 wherein said frame member legs at their inner perimetric edges have a thickness at least equal to the thickness of said display panel at its perimetric edges.

31. The method of claim 28, wherein said securing step comprises stitching said display panel to said attachment panel.

32. The method of claim 28, wherein said securing step comprises adhesively adhering said display panel to said attachment panel.

33. The method of claim 32, wherein said securing step comprises adhering said display panel to said attachment panel by a fabric-to-fabric contact adhesive, said attachment member comprising a porous panel.

34. The method of claim 32, wherein said securing step comprises adhering said display panel to said attachment panel by a heat sealing adhesive, said attachment panel comprising a porous panel whereby said heat sealing adhesive melts into said porous panel.

35. The method of claim 32, wherein said securing step comprises adhering said display panel to said attachment panel by a pressure sensitive adhesive, said attachment member comprising a porous panel whereby said pressure sensitive adhesive is compressed integrally into said porous panel.

36. The method of claim 32, wherein said securing step comprises adhering said display panel to said attachment panel by heat transfer, said indicia attachment panel comprising a porous panel capable of permitting heat transfer.

* * * * *